US011071898B2

(12) United States Patent
Cochran

(10) Patent No.: US 11,071,898 B2
(45) Date of Patent: Jul. 27, 2021

(54) TWO BALL, BALL STRIKING TRAINER

(71) Applicant: Hayden A. Cochran, Washington, DC (US)

(72) Inventor: Hayden A. Cochran, Washington, DC (US)

( * ) Notice: Subject to any disclaimer, the term of this patent is extended or adjusted under 35 U.S.C. 154(b) by 13 days.

(21) Appl. No.: 16/504,131

(22) Filed: Jul. 5, 2019

(65) Prior Publication Data

US 2021/0001198 A1 Jan. 7, 2021

(51) Int. Cl.

| | |
|---|---|
| ***A63B 69/38*** | (2006.01) |
| ***A63B 69/00*** | (2006.01) |
| *A63B 102/20* | (2015.01) |
| *A63B 102/02* | (2015.01) |

(52) U.S. Cl.

CPC ..... *A63B 69/0075* (2013.01); *A63B 69/0091* (2013.01); *A63B 69/0002* (2013.01); *A63B 2069/0011* (2013.01); *A63B 2102/02* (2015.10); *A63B 2102/20* (2015.10)

(58) Field of Classification Search

CPC ..... A63B 69/0075; A63B 69/0091; A63B 2102/02; A63B 2102/20; A63B 69/0002; A63B 2069/0011

See application file for complete search history.

(56) References Cited

U.S. PATENT DOCUMENTS

| | | | | |
|---|---|---|---|---|
| 2,082,818 A * | 6/1937 | Atwell | A63B 69/40 | 473/436 |
| 2,616,692 A | 11/1952 | Bird | | |
| 3,143,265 A | 8/1964 | Rudenan | | |
| 3,183,000 A | 5/1965 | Dix | | |
| 4,089,521 A | 5/1978 | Berst | | |
| 4,204,678 A * | 5/1980 | Weis | A63B 69/0091 | 473/423 |
| 4,460,172 A * | 7/1984 | Hogan | A63B 69/0091 | 473/426 |
| 4,508,340 A * | 4/1985 | Liao | A63B 69/0091 | 473/139 |
| 4,669,444 A | 6/1987 | Whitfield | | |
| 4,989,867 A * | 2/1991 | Herrick | A63B 69/0091 | 473/429 |
| 5,435,545 A * | 7/1995 | Marotta | A63B 69/0075 | 473/417 |
| 5,685,542 A * | 11/1997 | Weis | A63B 69/0091 | 473/459 |
| 6,398,671 B1 * | 6/2002 | Rios | A63B 69/0075 | 273/317.6 |
| 6,656,063 B2 * | 12/2003 | Prichard | A63B 69/0091 | 473/139 |
| 6,659,891 B2 | 12/2003 | Lloyd | | |

(Continued)

*Primary Examiner* — Joshua T Kennedy

(57) ABSTRACT

A ball sports, ball striking, practice and teaching aid which provides a unique two ball, ball striking practice design, that includes a fixed yet displaceable and self resetting ball and a second free to fly ball that is catapulted or tossed by using the energy that is provided by the force of impact between the fixed ball and a ball striking implement, for example a tennis racket or baseball bat, the fixed ball is situated at the uppermost end of a rigid, geniculated, longitudinally governed, displaceable, and self resetting wand, which crowns a rigid, unyielding, upright post that is affixed to a portable base of sufficient mass and weight to hold the upright post firmly in a perpendicular to the base, upright position.

1 Claim, 3 Drawing Sheets

(56) References Cited

U.S. PATENT DOCUMENTS

| | | | | |
|---|---|---|---|---|
| 9,149,707 | B2 | 10/2015 | Cochran | |
| 10,166,456 | B1 | 1/2019 | Decilveo | |
| 10,245,495 | B2 * | 4/2019 | Dagn | A63B 43/002 |
| 10,932,982 | B2 * | 3/2021 | Kabes | A63B 71/0009 |
| 2003/0224880 | A1 * | 12/2003 | Hansberry | A63B 69/0002 473/430 |
| 2016/0129329 | A1 * | 5/2016 | Fadde | A63B 69/0002 473/417 |
| 2019/0388753 | A1 * | 12/2019 | Paulson | A63B 69/0075 |
| 2021/0060401 | A1 * | 3/2021 | Cunnane | A63B 69/0091 |

* cited by examiner

TWO BALL, BALL STRIKING TRAINER

STATEMENT OF THE PURPOSE OF THE PRESENT INVENTION

To create and proffer a simple, portable, human powered three in one, ball striking teaching aid device.

FIELD OF THE INVENTION

The present invention relates to a ball sports, ball striking practice device as could be used in baseball or tennis practice, more particularly, this invention relates to a two ball, ball striking practice device.

OBJECTS OF THE INVENTION

To provide a practical combined, fixed ball and second, separate, live ball, ball striking, practice device.

To provide a device that combines the advantages and benefits of a static yet realistic feeling, full impact, ball striking, practice device and the advantages of a device that responsively throws mechanically governed, live balls.

To provide a human powered mechanically enhanced live ball catapult.

BRIEF SUMMARY OF THE INVENTION

The general idea, purpose and substance of the present invention is to provide the combined benefits of three separate and specific categories of ball striking practice devices. A portable three in one, simple, ergonomically designed ball striking, teaching aid and devices.

One specific categorical reference would include all single ball, fixed yet displaceable ball striking practice devices.

An additional categorical reference would include all free to fly, tee ball, assembly practice devices.

A further specific categorical reference would include all mechanical ball tossing or throwing, practice device.

A single fixed yet displaceable ball, striking practice devices will not have the obvious sensory and tactile advantages of the present invention. A two ball, ball striking practice device.

A separate and specific, practical advantage of this two ball, ball striking practice device is that the, free to fly and catapulted ball, is envisioned as a now, strikable and returnable mechanically governed and tossed free flying, practice ball.

Said free flying practice ball, would be suitable for new and effective ball catching and retrieving, activities drills, and games, as would be the case in cricket or baseball practice. Or new, ball striking and ball returning activities, drills and games as would be the case in tennis practice.

BACKGROUND OF THE INVENTION

It is a generally accepted point of view that many of the frustrations and complexities of learning to hit a moving target could be substantially reduced by first learning to proficiently hit a stationary, fixed or static target. Baseball, cricket and tennis are all sports that require the hitting of a moving target. A ball, that is a moving target. Stationary or fixed ball striking practice devices are well known in the prior art. Of particular reference U.S. Pat. No. 6,659,891 of Lloyd issued Dec. 9, 2002. U.S. Pat. No. 4,089,521 of Berst issued May 16, 1978. U.S. Pat. No. 4,204,678 of Weis issued May 27, 1980. U.S. Pat. No. 9,149,707 of Cochran issued Oct. 6, 2015. However, none of these referenced ball striking practice devices have the added advantage of a second nesting yet, free to fly ball. Within the prior art there are nesting, yet free to fly ball striking practice devices. Of particular reference U.S. Pat. No. 2,616,692 of Bird issued Nov. 4, 1952. U.S. Pat. No. 3,143,265 of Ruderian Issued Aug. 4, 1964. U.S. Pat. No. 3,183,000 of Dix issued May 11, 1965. Of these referenced nesting yet free to fly, ball striking practice devices, all are of a simple, similar, tee ball design and assembly. Said design demonstrates a high likelihood of the ball striking instrument, the bat or racket, to come into direct and forceful contact with the tee ball assembly itself. This likelihood exist because, the ball and the ball support surface shared space. The direct and forceful impact, between a standard baseball bat and a common tee ball assembly, is not likely to noticeably diminish the effectiveness of a standard baseball bat. Conversely a standard tennis racket could easily be permanently damaged by direct forceful impact with any common yet sturdy tee ball assembly. Ball tossing or ball throwing mechanical devices are well known in the prior art. Of particular reference U.S. Pat. No. 4,669,444 of Whitfield issued Jun. 2, 1987. U.S. Pat. No. 8,287,404 of Cucjen, issued Oct. 16, 2012. U.S. Pat. No. 10,166,456 of Decilveo issued Jan. 1, 2019. A common drawback among typical ball throwing machines is that they tend to be electrically powered, bulky, overly complex and quite expensive.

Other objects, novel features and advantages of the present invention will become apparent upon making reference to the following brief descriptions, detailed descriptions and the accompanying drawings. The descriptions and the drawings will also further disclose the characteristics of this invention, both as to its structure and its mode of operation. Although, preferred embodiments of the present invention are described hereinbelow, and shown in the accompanying drawings, it must be expressly understood that the descriptions and drawings thereof are for the purpose of illustration only and do not limit the scope of this invention.

DETAILED DESCRIPTION OF THE PREFERRED EMBODIMENTS

Figure 1:
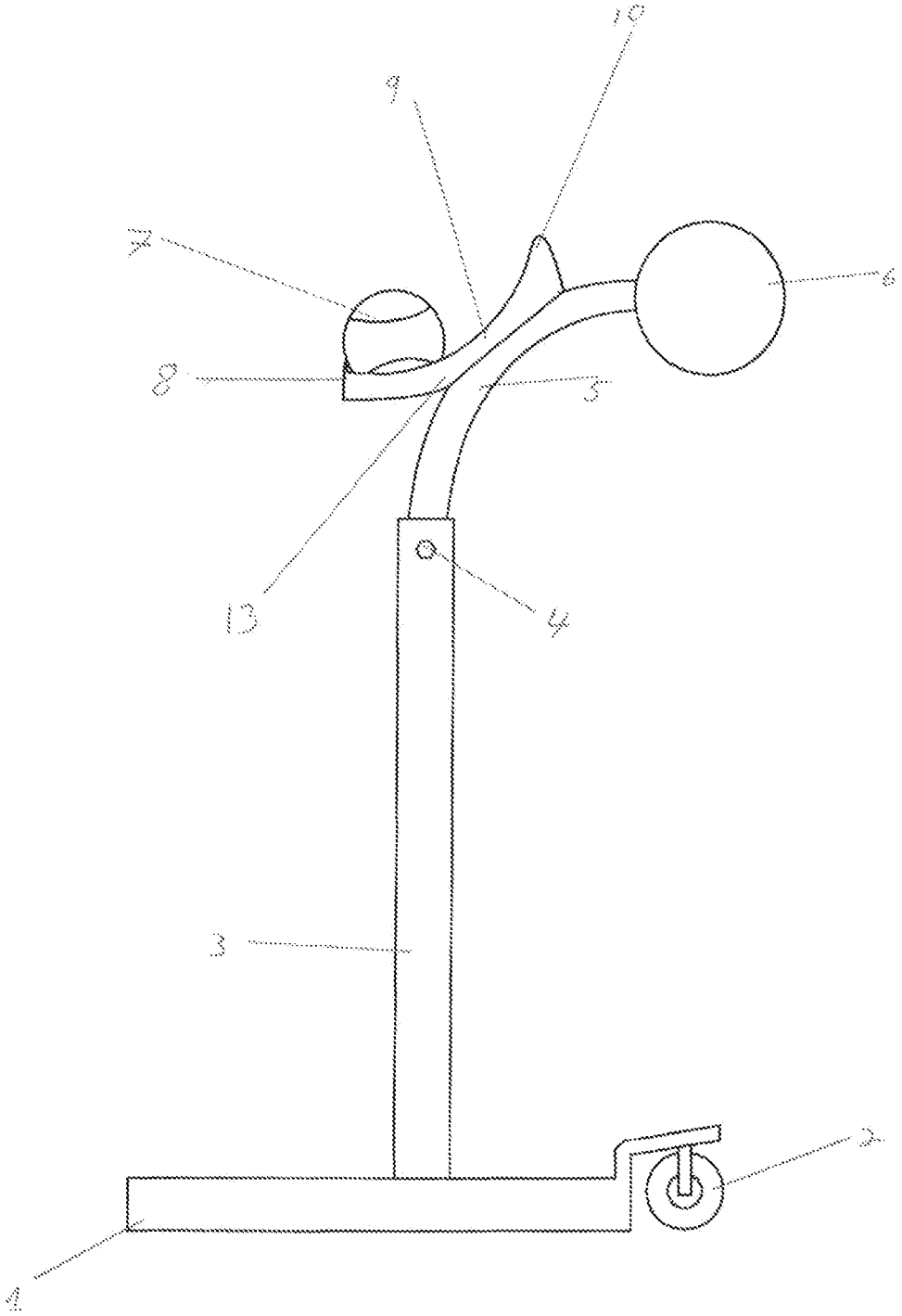
FIG. 1 is a perspective full, side on view, that illustrates an embodiment of the present invention at full rest.

Now referring to FIG. 1 there is illustrated a ball striking practice device particularly adaptable to baseball, cricket or tennis in accordance with the present invention is included, a base (1) as illustrated. The base (1) has mounted wheels (2) for the purpose of simple transportability. The base (1) must be of sufficient mass and weight for the stable affixed perpendicular placement and support of a rigid and unyielding up right post (3). The rigid up right post (3) is crowned and affixed with a rigid geniculated and specifically counterbalanced, wand (5). The rigid wand (5) is affixed to the crown of the rigid up right post (3) by means of a through pin (4) which allows the rigid wand (5) to be displaced only, along a longitudinal, outward bound and governed, path.

The first of two balls that are depicted and illustrated herein is the strikable, impact ball (6). The impact ball (6) is securely mounted and fixed to the highest end of the rigid wand (5). Affixed and mounted as illustrated, opposite the impact ball, (6) in the manner of a piggyback arrangement, is a one piece, three sectional ball throwing device (13). The three sections of the piggyback arranged ball throwing device, (13) are, section one. The free to fly, ball nesting surface, (8) which serves as suitable support for the nesting free to fly ball (7) while waiting in readiness to be catapulted. The second section of the piggyback arranged ball throwing device, (13) is the free to fly ball acceleration trough, (9) which performs as an accelerant on the free to fly ball (7) in precisely the same manner as a Jai Alai racket serves to accelerate a Jai Alai ball through to the Jai Alai racket's release point. The third section of the piggyback arranged ball throwing device (13) is the ball directional releasing hood (10). An envisioned element of the ball directional releasing hood (10) is the adjustability of the ball releasing directional hood (10). Said adjustability will impose varied degrees of arc, upon the catapulted free flying ball.

Figure 2:
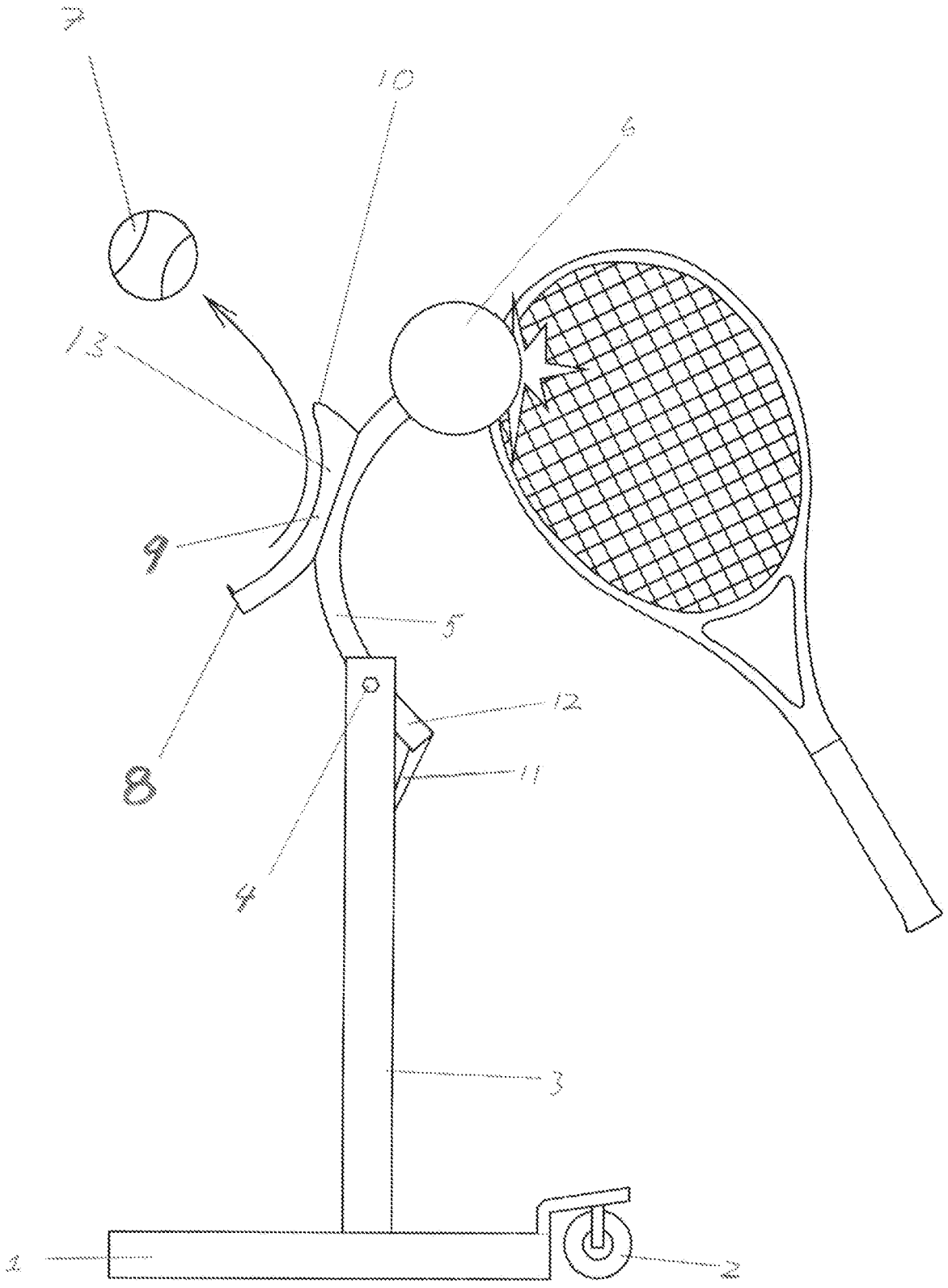
FIG. 2 is a perspective full, side on view that illustrates an embodiment of the present invention in depiction of, the present invention immediately following the impact between the fixed yet displace ball and an impacting tennis racket.

Now referring to FIG. 2 illustrating and depicting the desired clause and effects envisioned within the present invention.

Upon being struck by the ball striking instrument, depicted in FIG. 2 as a tennis racket, the strikable and displaceable impact ball (6) services to convert the force of the impact between the racket and the impact ball (6) into the energy that powers the free to fly ball's catapult response. Also illustrated and depicted in FIG. 2 are two separate and distinct balls. An impact ball (6) and a free to fly ball that can be catapulted (7) Also illustrated and depicted in FIG. 2 are two separate and distinct fixed impact ball (6) return devices. One of these two ball return devices is a specifically weighted counterbalance wand ending (12) and the second of the two impact ball, (6) ball return devices is an elastic bungee cord (11) that is strategically connected to the up right post (3) at one end and the opposite end of the elastic bungee cord (11) is attached to the specifically weighted counterbalanced end of the rigid wand (12).

Figure 3:
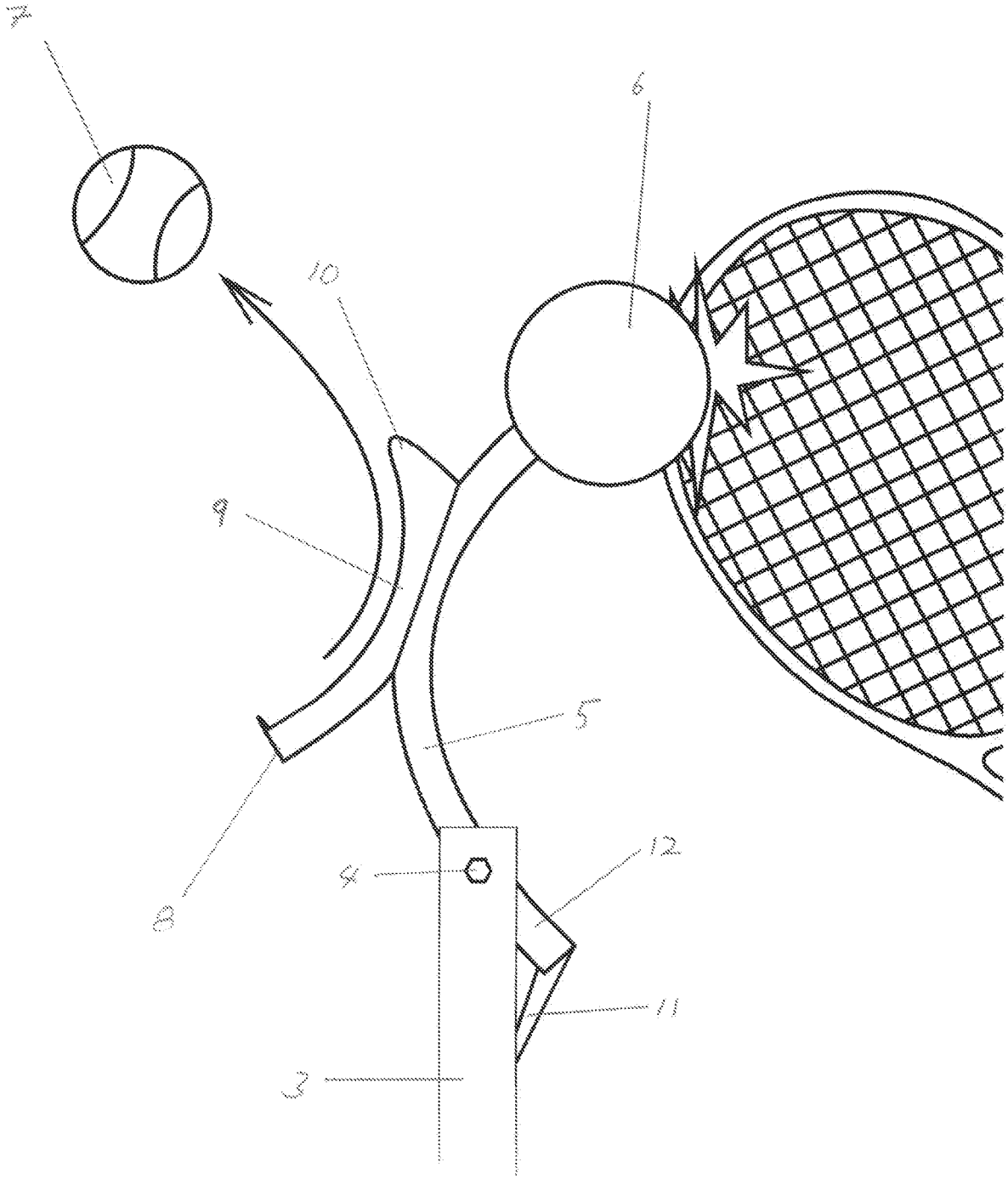
FIG. 3 is a perspective and truncated yet enlarged side on view that illustrates an embodiment of the present invention immediately following the contact between the fixed yet displace ball and an impacting tennis racket.

Now referring to FIG. 3 which in accordance with the present invention illustrates and depicts a truncated and sectional yet, blown up view of the two ball, ball striking practice device as illustrated and described in FIG. 2

What I claim in my invention:

1. A ball striking and ball catapulting device, comprising:

a base member configured to be substantially parallel with a playing surface;

an upright, rigid, and unyielding post member set in and fixed substantially perpendicular to said base member;

a rigid, geniculated wand member having a concave side and a convex side, said wand member pivotably mounted to a top end of said post member by a pivot pin adjacent a first end of said wand member and further comprising a fixed, strikable ball member mounted at a second end of said wand member;

an elastic or spring member attached between the post member and the first end of the wand member to allow the wand member to automatically reset to its initial position after the fixed ball is struck;

a curved trough member attached to said concave side of the wand member, said trough member having a nesting portion at a first end which is configured to hold a second separate, non-strikable, catapulting ball in the initial position of the wand member and an adjustable releasing hood portion at a second end; and wherein the fixed ball is configured to be impacted by a striking implement at the initial position which catapults a catapulting ball from within the trough member in a direction dictated by the hood portion.

* * * * *